US007832441B2

(12) United States Patent
Titz

(10) Patent No.: US 7,832,441 B2
(45) Date of Patent: Nov. 16, 2010

(54) CORRUGATED CARDBOARD MACHINE AND METHOD OF PRODUCING AN ENDLESS WEB OF CORRUGATED CARDBOARD

(75) Inventor: Felix Titz, Weiherhammer (DE)

(73) Assignee: BHS Corrugated Maschinen-und Anlagenbau GmbH, Weihernammer (DE)

( * ) Notice: Subject to any disclaimer, the term of this patent is extended or adjusted under 35 U.S.C. 154(b) by 262 days.

(21) Appl. No.: 12/251,827

(22) Filed: Oct. 15, 2008

(65) Prior Publication Data

US 2009/0120563 A1 May 14, 2009

(30) Foreign Application Priority Data

Nov. 14, 2007 (DE) ..... 10 2007 054 194

(51) Int. Cl.
*G05G 15/00* (2006.01)

(52) U.S. Cl. ..... 156/350; 156/64; 156/202; 156/205; 156/206; 156/210; 156/351; 156/378; 156/379; 156/462

(58) Field of Classification Search ..... 156/64, 156/202, 205, 206, 208, 210, 350, 351, 378, 156/379, 462
See application file for complete search history.

(56) References Cited

U.S. PATENT DOCUMENTS 5,101,761 A 4/1992 Isowa
5,393,294 A * 2/1995 Jobst ..... 493/342
5,857,395 A * 1/1999 Bohm et al. ..... 83/408
2004/0089394 A1* 5/2004 Guilmartin et al. ..... 156/64
2006/0083900 A1* 4/2006 Ashraf ..... 428/182
2006/0278342 A1* 12/2006 Baierl et al. ..... 156/378

FOREIGN PATENT DOCUMENTS

DE 10131832 A1 1/2003
DE 102006003200 A1 8/2007

OTHER PUBLICATIONS

Copending U.S. Appl. No. 12/137,884 (confidentiality of which is not waived).

* cited by examiner

*Primary Examiner*—Kat Wyrozebski
*Assistant Examiner*—Joshel Rivera
(74) *Attorney, Agent, or Firm*—Browdy and Neimark, PLLC

(57) ABSTRACT

In a corrugated cardboard machine and in a method of producing a web of corrugated cardboard, an electronic control device is provided in order to avoid downtimes of the corrugated cardboard machine, said control device being designed such that at least one web length of the web of corrugated cardboard between the at least one production device and a longitudinal cutting device is detectable and an application width of the at least one production device is variable in dependence on the at least one web length. Changing the application width prevents an escape of glue from the sides so that there is no need for cleaning.

10 Claims, 7 Drawing Sheets

CORRUGATED CARDBOARD MACHINE AND METHOD OF PRODUCING AN ENDLESS WEB OF CORRUGATED CARDBOARD

BACKGROUND OF THE INVENTION

1. Field of the Invention

The invention relates to a corrugated cardboard machine and a method of producing an endless web of corrugated cardboard.

2. Background Art

During the production of endless webs of corrugated cardboard, a corrugated web is at first coated with glue by means of a first gluing device and joined to a first liner to form a single-face web of corrugated cardboard. Afterwards, the corrugated web is coated with glue on the side opposite the first liner by means of a second gluing device and joined to a second liner to form a double-face web of corrugated cardboard. As at least some of the orders to be processed have an order width which substantially equals the width of the webs, the webs are coated with glue and bonded together up to their edges. A disadvantage is that when the webs are coated with glue and bonded together up to their edges, glue may escape from the sides and contaminate components of the corrugated cardboard machine such as the grooving rollers or the heating plates. Such contaminations result in a higher wear of the components so that in order to prevent said wear, the components require more frequent cleaning. The corrugated cardboard machine is switched off during cleaning which is undesirable for reasons of economy. Furthermore, the corrugated cardboard machine produces rejects when a particular level of contamination is reached.

A gluing device is disclosed in U.S. Pat. No. 5,101,761 which comprises lateral plates so as to prevent glue applied by means of a glue application roller from escaping from the sides. The gluing device further comprises glue dams which are displaceable crosswise to a direction of conveyance of the corrugated web to be coated with glue, thus enabling an application width of the gluing device to be adapted to the web width of the corrugated web. Since the webs are coated with glue and bonded together up to their edges, this gluing device also has the disadvantages described above.

SUMMARY OF THE INVENTION

Thus it is the object of the invention to develop a corrugated cardboard machine and a method of producing webs of corrugated cardboard such that the maintenance effort, the resulting downtime of the corrugated cardboard machine and the glue consumption are reduced.

This object is achieved by a corrugated cardboard machine for production of an endless web of corrugated cardboard, the corrugated cardboard machine comprising a. at least one production device for producing an endless web of corrugated cardboard from a corrugated web and at least one liner, wherein
   i. the at least one production device comprises at least one gluing device for applying glue to the corrugated web, and wherein
   ii. the at least one gluing device is designed such that an application width is variable crosswise to a direction of conveyance, b. a longitudinal cutting device disposed downstream of the at least one production device when seen in the direction of conveyance for longitudinal cutting of the endless web of corrugated cardboard, and c. an electronic control device which is designed such that
   i. at least one web length of the web of corrugated cardboard between the at least one production device and the longitudinal cutting device is detectable, and
   ii. the application width is variable in dependence on the at least one web length.

Furthermore, this object is achieved by a method of producing an endless web of corrugated cardboard, the method comprising the following steps:

providing a corrugated web and at least one liner, applying glue to an application zone of the corrugated web by means of at least one production device, wherein the application zone has an application width crosswise to a direction of conveyance, joining the corrugated web coated with glue to the at least one liner to form an endless web of corrugated cardboard by means of the at least one production device, detecting at least one web length of the web of corrugated cardboard between the at least one production device and a longitudinal cutting device, changing the application width in dependence on the at least one detected web length, and longitudinal cutting of the web of corrugated cardboard by means of the longitudinal cutting device.

It has been found according to the invention that only few orders, in other words custom-made corrugated cardboard produced according to individual requirements, have a width which requires the webs to be coated with glue and bonded together across the entire web width. The control unit, by means of which the at least one length of the web of corrugated cardboard between the at least one production device and the longitudinal cutting device is detectable, enables the glue application width, hereinafter referred to as application width, to be adapted to the width of the orders. When the application width is adapted to the order width, the webs are not coated with glue and bonded together up to their edges, with the result that hardly any glue is able to escape from the sides. As the change of format is performed between two orders by means of the longitudinal cutting device, the application width needs to be changed in dependence on the at least one detected web length by means of the at least one production device upstream of the longitudinal cutting device. The control unit actuates the at least one production device in dependence on the at least one detected web length and in dependence on an order length of an order not yet processed in the longitudinal cutting device and changes the application width at the very moment when the order length, which is still to be processed, equals the at least one web length. This ensures that the change of the application width takes place at the same spot as the change of format in the longitudinal cutting device. The edge strips of the web of corrugated cardboard to which no glue is applied are removed by means of the longitudinal cutting device during the format change. Adapting the application width to the respective order width substantially prevents glue from escaping from the sides. Contamination caused by escaped glue is substantially avoided, with the effect that cleaning and the resulting downtimes are reduced. Furthermore, this helps to avoid the production of rejects and to save glue.

Further features and details of the invention will become apparent from the description of an embodiment by means of the drawing.

DESCRIPTION OF THE PREFERRED EMBODIMENT

Figure 1:
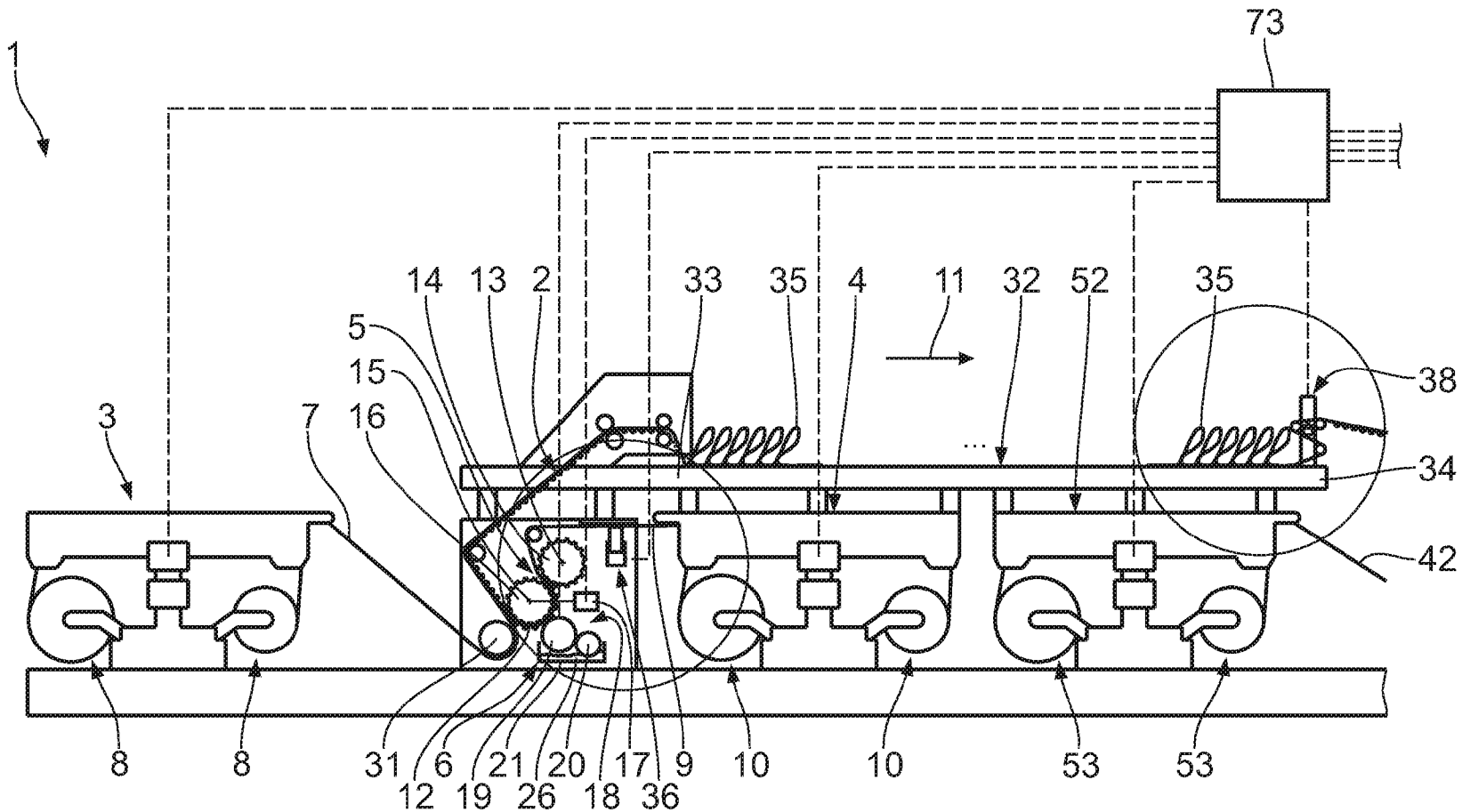
FIG. 1 shows a first part of a corrugated cardboard machine.

In order to produce a single-face web of corrugated cardboard 2, a corrugated cardboard machine 1 comprises a first splicing device 3, a second splicing device 4, a grooving device 5 and a first production device 6. In order to provide an endless first liner 7, the first splicing device 3 comprises two unrolling units 8 and a cutting and joining device (not shown). The exact design of the first splicing device 3 is described in DE 10 2006 003 200 A. The second splicing device 4 is designed like the first splicing device 3, thus comprising two second unrolling units 10 for providing an endless web of material 9.

The grooving device 5 is disposed downstream of the splicing devices 3, 4 in a direction of conveyance 11. The grooving device 5 serves for producing an endless corrugated web 12 from the endless web of material 9. The grooving device 5 comprises a first grooving roller 14 which is drivable for rotation about a first axis of rotation 13 and a second grooving roller 16 which is drivable for rotation about a second axis of rotation 15. The grooving rollers 14, 16 form a gap through which the endless web of material 9 is passed and provided with grooves, wherein the axes of rotation 13, 15 are parallel to each other. The second grooving roller 16 is provided with a measuring device 17 for measuring the rotational speed of the second grooving roller 16.

The first production device 6 comprises a first gluing device 18 which applies glue to the corrugated web 12 and joins said corrugated web 12 to the first liner 7 to form the single-face web of corrugated cardboard 2. The first gluing device 18 comprises a first glue application roller 19, a first glue metering roller 20 and a first glue container 21. The first glue container 21 delimits a container interior 22. The container interior 22 is divided, by means of glue dams 23, into a central glue space 24 and lateral free spaces 25. The glue space 24 is filled with glue 26. The glue dams 23 closely adhere to the glue container 21 so as to ensure that the glue space 24 is sealed towards the free spaces 25.

The glue dams 23 are individually displaceable in a direction of displacement 27 which is crosswise to the direction of conveyance 11. The glue dams 23 have a threaded sleeve 28 at each of their respective free ends, the threaded sleeve 28 cooperating with a respective threaded rod 29. The threaded rods 29 are mounted for rotation on the first glue container 21 and are in each case drivable for rotation by means of an individual drive 30. The glue dams 23 define a distance between each other which is referred to as application width $B_L$. The first glue metering roller 20 is partly arranged in the first glue container 21 for absorbing glue 26. The first glue metering roller 20 bears against the first glue application roller 19 and serves to form a uniform layer of glue on the first glue application roller 19. In order to apply glue 26 to the corrugated web 12, the first glue application roller 19 forms a gap with the second grooving roller 16 through which the corrugated web 12 may pass. The first production device 6 further comprises a first pressing roller 31 for pressing the corrugated web 12 coated with glue 26 against the first liner 7.

When seen in the direction of conveyance 11, a storage device 32 is disposed downstream of the first production device 6 for temporary storage of the single-face web of corrugated cardboard 2. The single-face web of corrugated cardboard 2 is moved in the storage device 32 from a storage device front end 33 to a storage device rear end 34, wherein the single-face web of corrugated cardboard 2 forms loops 35. The storage device 32 is formed like a table and is referred to as bridge in technical language.

Relative to the direction of conveyance 11, a marking device 36 is disposed upstream of the storage device 32. The marking device 36 serves for the application of markings 37 to the endless web of material 9. The marking device 36 is arranged between the second splicing device 4 and the grooving device 5 such that the markings 37 are applicable to an underside of the endless web of material 9. With respect to the exact design and functioning of the marking device 36, reference shall be made to DE 10 2007 027 879.0.

When seen in the direction of conveyance 11, a detector device 38 is disposed downstream of the storage device 32 for detecting the markings 37, wherein the detector device 38 is arranged between the storage device 32 and a second production device 39. The detector device 38 comprises an optical detector 40 which is mounted to a detector carrier 41. The detector carrier 41 is fastened to the storage device 32 at the storage device rear end 34. With respect to the exact design and functioning of the detector device 38, reference shall be made to 10 2007 027 879.0.

The second production device 39 serves for applying glue and joining the single-face web of corrugated cardboard 2 to an endless second liner 42 to form a double-face web of corrugated cardboard 43. The double-face web of corrugated cardboard 43 has a web width $B_B$. The second production device 39 comprises a second gluing device 44. The second gluing device 44 is designed like the first gluing device 18, thus comprising a second glue application roller 45, a second glue metering roller 46 and a second glue container 47. A pressing table 48 and an endless pressing belt 49 forming a pressing gap 50 are provided for pressing the second liner 42 to the single-face web of corrugated cardboard 2 coated with glue 26. The pressing belt 49 is deflected via three belt deflecting rollers 51 and is drivable. The pressing table 48 is provided with heating plates for heating the double-face web of corrugated cardboard 43.

A third splicing device 52 is provided for producing the endless second liner 42. The third splicing device 52 is designed like the splicing devices 3, 4, thus comprising corresponding third unrolling units 53.

When seen in the direction of conveyance 11, a grooving device 54 and a longitudinal cutting device 55 are disposed downstream of the production devices 6, 39. The grooving device 54 and the longitudinal cutting device 55 are designed integrally to form a longitudinal cutting and grooving device 55, 54. The grooving device 54 comprises a first grooving unit 56 and a second grooving unit 57. The grooving units 56, 57 comprise in each case two tool beds which are substantially arranged one above the other so as to be mirror symmetric to the web of corrugated cardboard 43. The tool beds are pivotable, thus ensuring that grooving tools 58 are individually engageable with the web of corrugated cardboard 43. The grooving tools 58 are individually displaceable crosswise to the direction of conveyance 11.

The longitudinal cutting device 55 comprises a first longitudinal cutting unit 59 and a second longitudinal cutting unit 60 disposed downstream thereof. Longitudinal cutting of the double-face web of corrugated cardboard 43 is performed by means of cutting tools 61 of the longitudinal cutting units 59, 60, said cutting tools 61 being mounted on tool carriers so as to be individually engageable with the web of corrugated cardboard 43 and individually displaceable crosswise to the direction of conveyance 11. With respect to the exact design and functioning of the grooving device 54 and the longitudinal cutting device 55, reference shall be made to U.S. Pat. No. 6,071,222 and to DE 101 31 832 A.

The longitudinal cutting device 55 serves for longitudinal cutting of the double-face web of corrugated cardboard 43 into several partial webs of corrugated cardboard 62. The respective two outer cutting tools 61 of the longitudinal cutting units 59, 60 serve for longitudinal cutting at the edges, thus enabling edge strips 63 to be cut off the web of corrugated cardboard 43. The outer cutting tools 61 of the longitudinal cutting units 59, 60 define in each case a tool distance $B_W$ which is variable by displacing the outer cutting tools 61 crosswise to the direction of conveyance 11.

When seen in the direction of conveyance 11, a cross-cutting device 64 is disposed downstream of the longitudinal cutting device 55. The cross-cutting device 64 comprises a knife bar roller 65 which is drivable for rotation and extends across the entire web width $B_B$. Relative to the web of corrugated cardboard 43, several support units 66 are arranged in succession on a side opposite to the knife bar roller 65. The support units 66 are in each case connected to a piston cylinder unit 67 such that the support units 66 are individually displaceable along the direction of conveyance 11. The cross-cutting device 64 serves for partially cutting the web of corrugated cardboard 43 in a crosswise direction during a format change. With respect to the exact design and functioning of the cross-cutting device 64, reference shall be made to US 2006/0086217 A.

When seen in the direction of conveyance 11, an edge-strip discharge device 68 is disposed downstream of the cross-cutting device 64. The edge-strip discharge device 68 serves for removal of the cut-off edge strips 63.

When seen in the direction of conveyance 11, a diverter 69 is disposed downstream of the edge-strip discharge device 68. The diverter 69 comprises a feed table 70 and two discharge tables 71 disposed one above the other. Between the feed table 70 and the discharge tables 71 is arranged a diverter element 72 which serves to distribute the partial webs of corrugated cardboard 62 among two planes. Further cross-cutting devices are arranged downstream of the diverter 69 in a known manner for cross-cutting the partial webs of corrugated cardboard 62 into sheets of corrugated cardboard; furthermore, a stacking device is provided.

The web of corrugated cardboard 2, 43 located between the first production device 6 and the longitudinal cutting device 55 has a first web length $L_1$. The first web length $L_1$ is composed of a first partial web length $L_{11}$ describing the length of the web of corrugated cardboard 2 between the first production device 6 and the storage-device rear end 34 of the storage device 32, and a second partial web length $L_{12}$ describing the length of the web of corrugated cardboard 2, 43 between the storage-device rear end 34 and the longitudinal cutting device 55.

Owing to the web of corrugated cardboard 2 in the storage device 32, the first partial web length $L_{11}$ is variable whereas the second partial web length $L_{12}$ is known and remains constant. The web of corrugated cardboard 2 between the second production device 39 and the longitudinal cutting device 55 has a second web length $L_2$. The second web length $L_2$ is known and remains constant.

Figure 2:
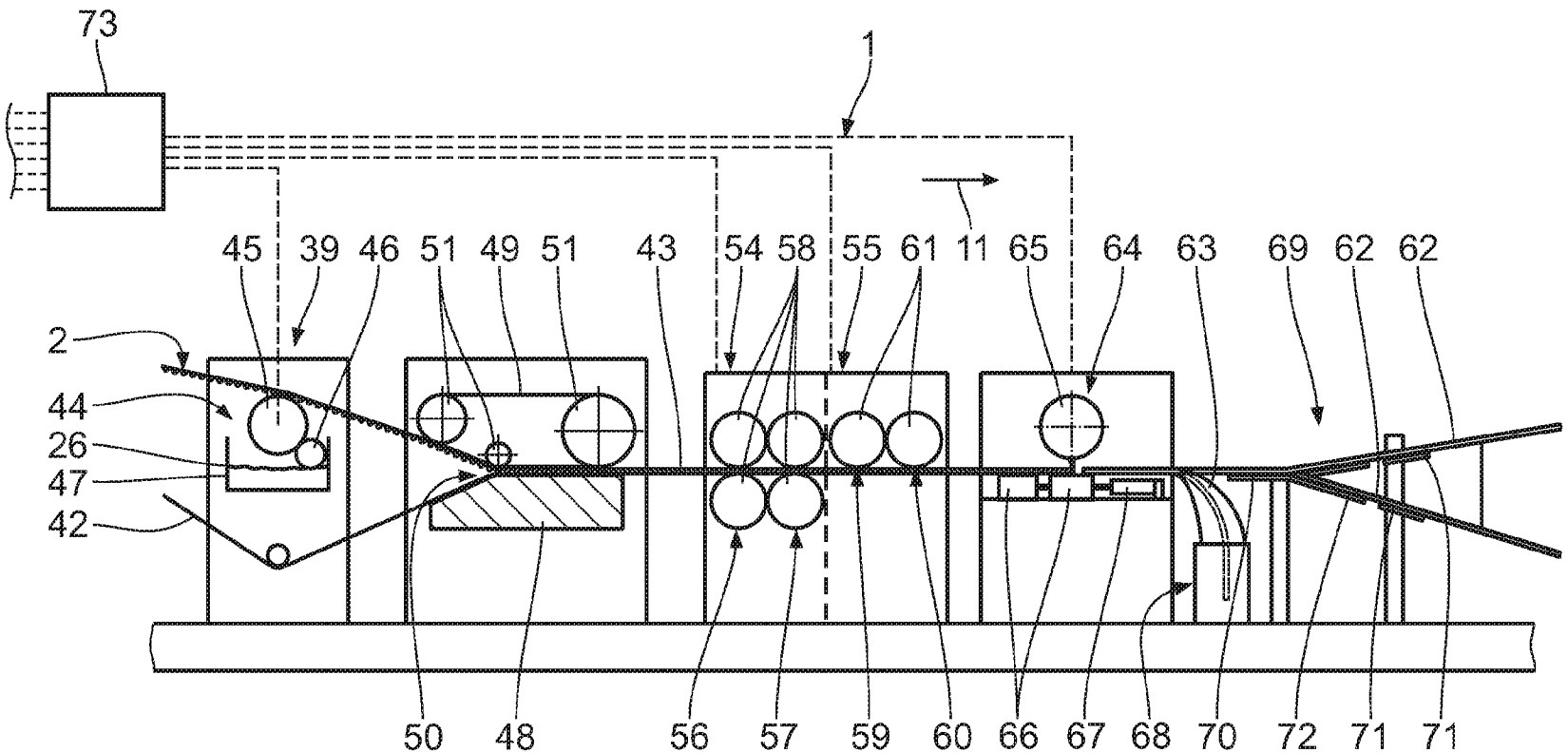
FIG. 2 shows a second part of a corrugated cardboard machine.
Figure 3:
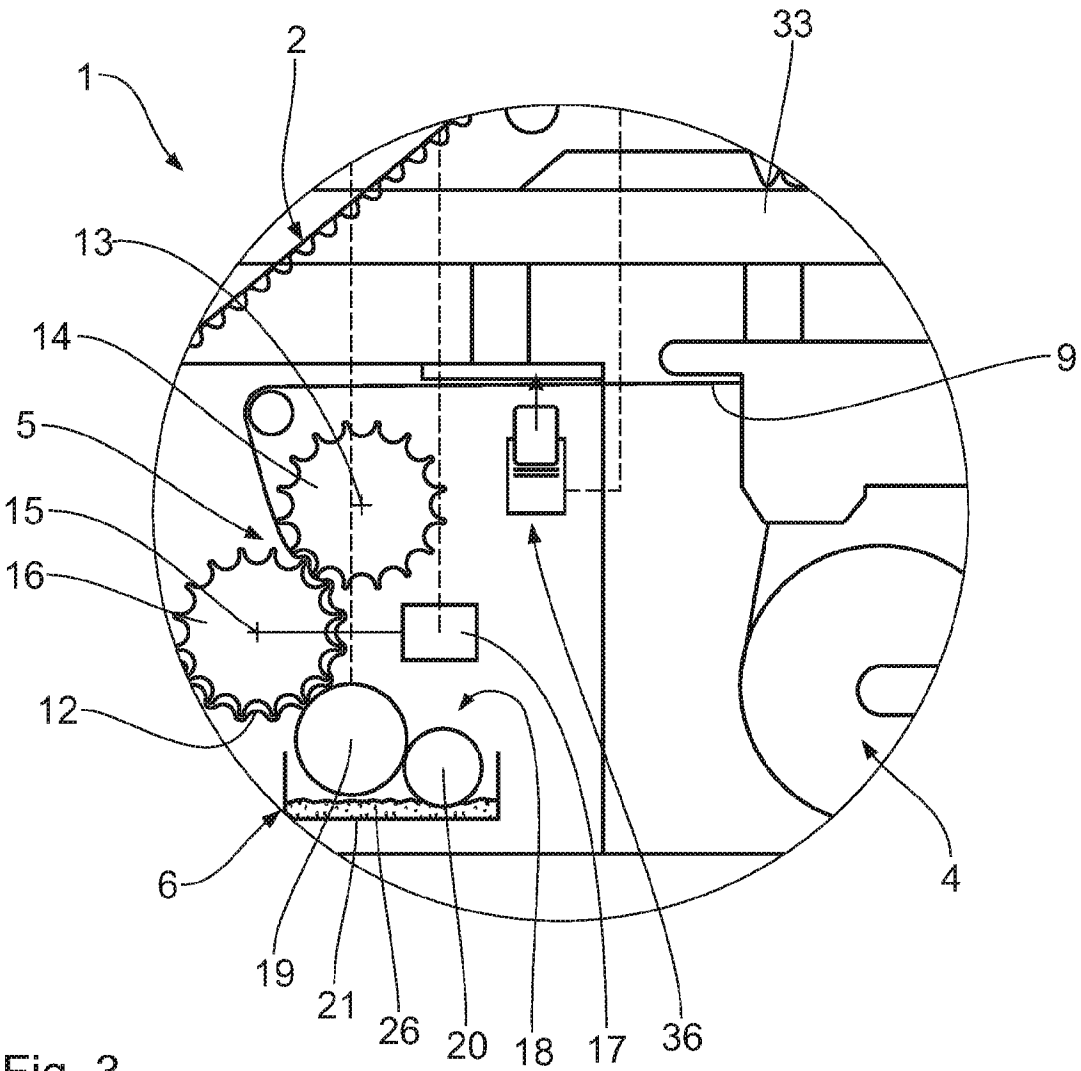
FIG. 3 shows an enlarged sectional view of the corrugated cardboard machine of FIG. 1 in the vicinity of a gluing device and a marking device.
Figure 4:
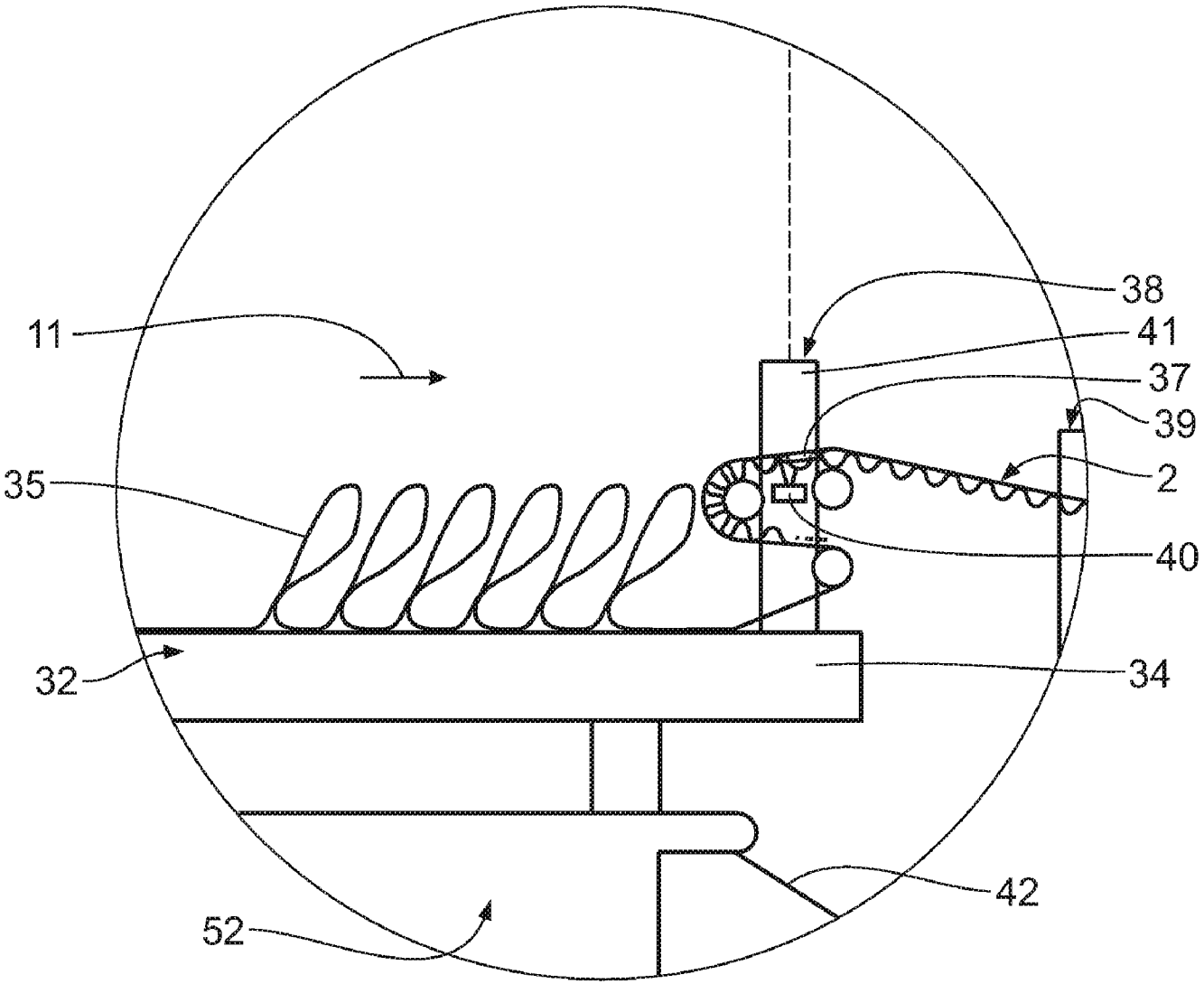
FIG. 4 shows an enlarged sectional view of the corrugated cardboard machine of FIG. 1 in the vicinity of a detector device.
Figure 5:
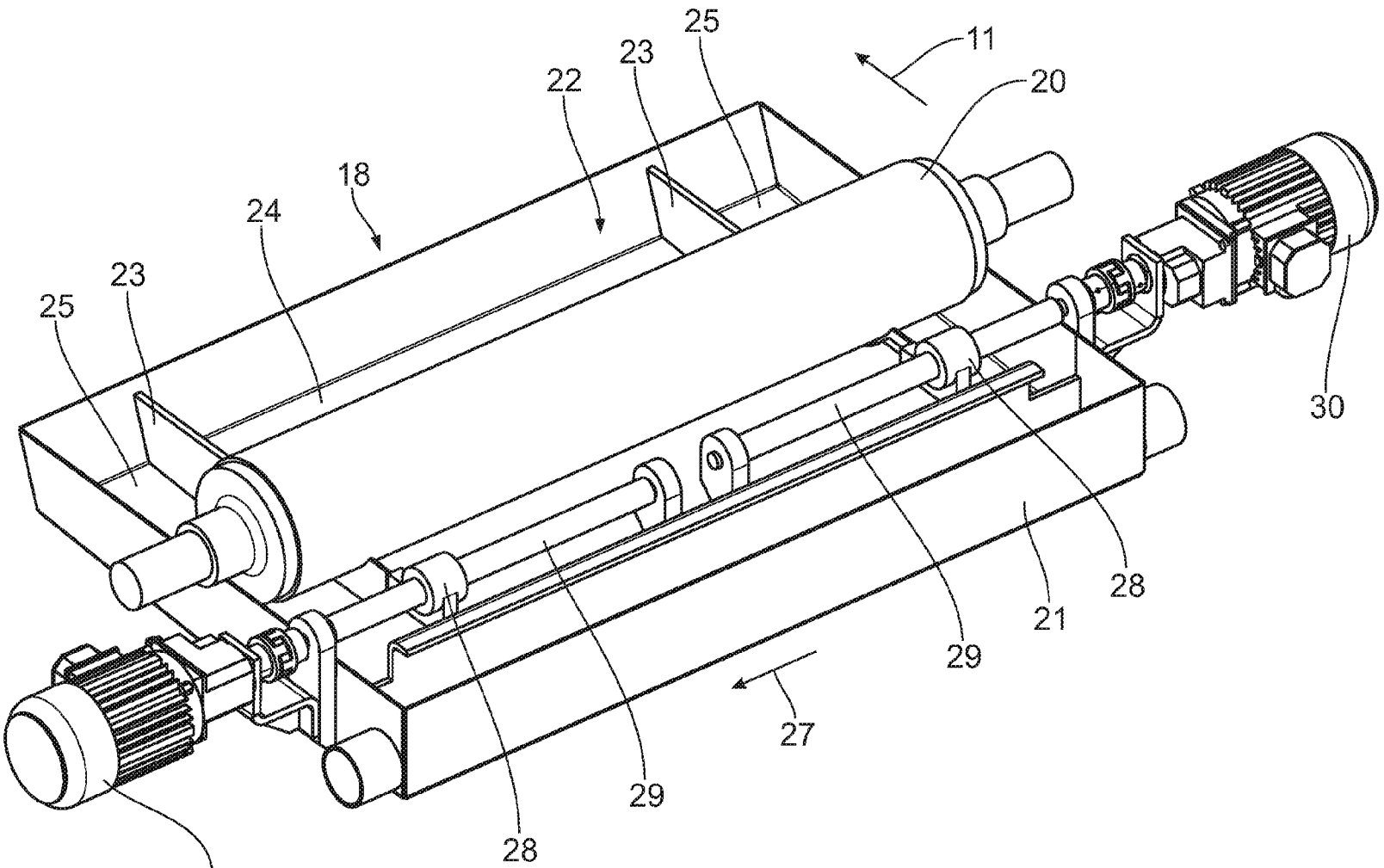
FIG. 5 shows a perspective view of a part of the gluing device of FIG. 3.
Figure 6:
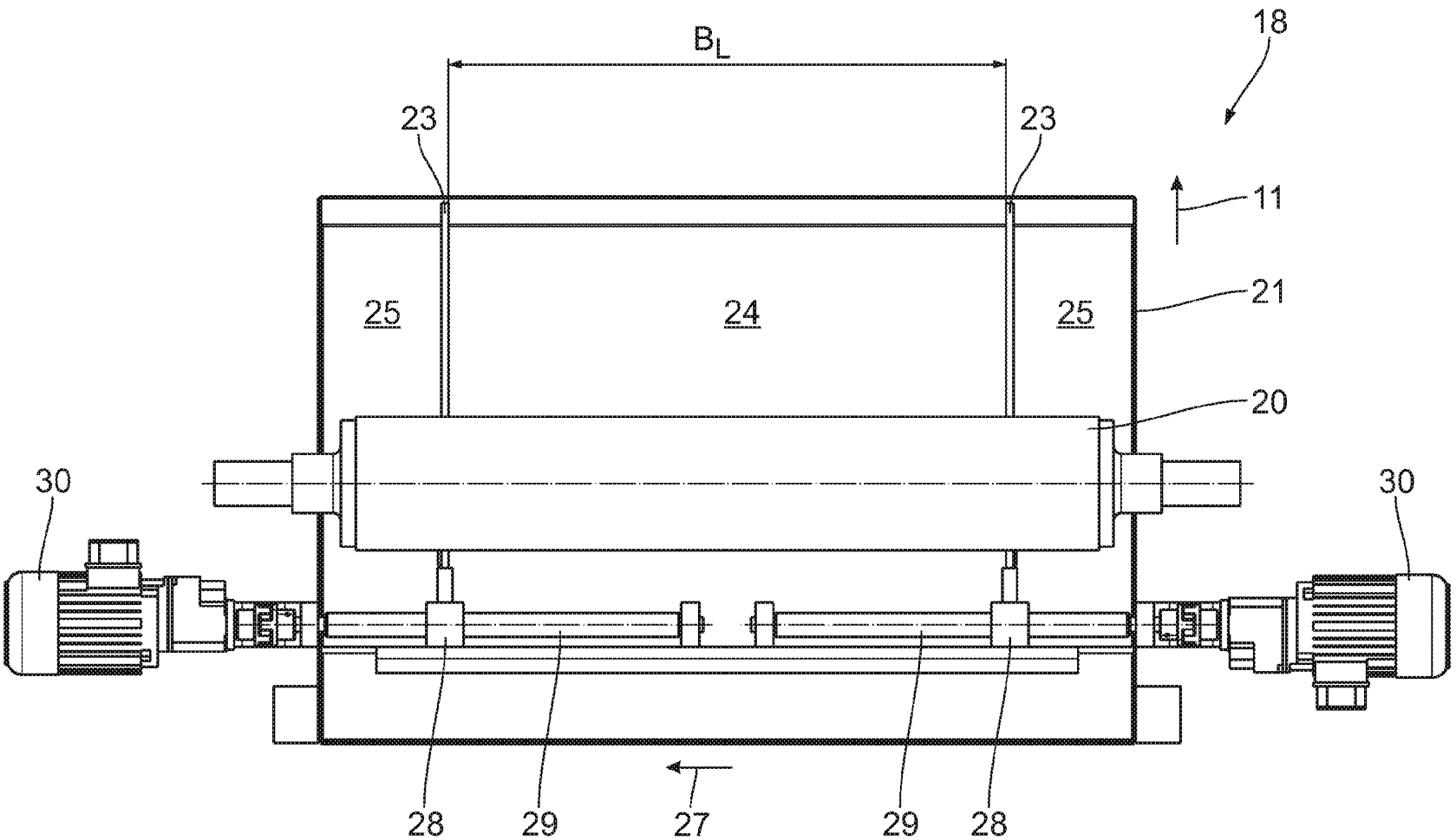
FIG. 6 shows a plan view of the gluing device of FIG. 5.

Control of the corrugated cardboard machine 1 is performed by means of an electronic control device 73 which is connected to the splicing devices 3, 4, 52, to the production devices 6, 39, to the measuring device 17, to the marking device 36, to the detector device 38, to the longitudinal cutting and grooving device 55, 54, and to the cross-cutting device 64 by means of signals. The signal connections are shown in FIGS. 1 and 2 by means of dashed lines. The control device 73 is designed such that the first and second web lengths $L_1$, $L_2$ are detectable and the application widths $B_B$ of the first and second gluing devices 18, 44 are variable in dependence on the first and second web lengths $L_1$, $L_2$. The control device 73 is further designed such that the cutting tools 61 of the longitudinal cutting device 55 are actuable and the tool distance $B_W$ of the outer cutting tools 61 is adaptable to the application width $B_L$ of the gluing devices 18, 44.

The following describes the functioning of the corrugated cardboard machine 1 by means of a format change. A first order $A_1$ has a first order length $L_{A1}$ and a first order width $B_{A1}$. A following second order $A_2$ has a second order length $L_{A2}$ and a second order width $B_{A2}$ which are different from the first order length $L_{A1}$ and the first order width $B_{A1}$.

Figure 7:
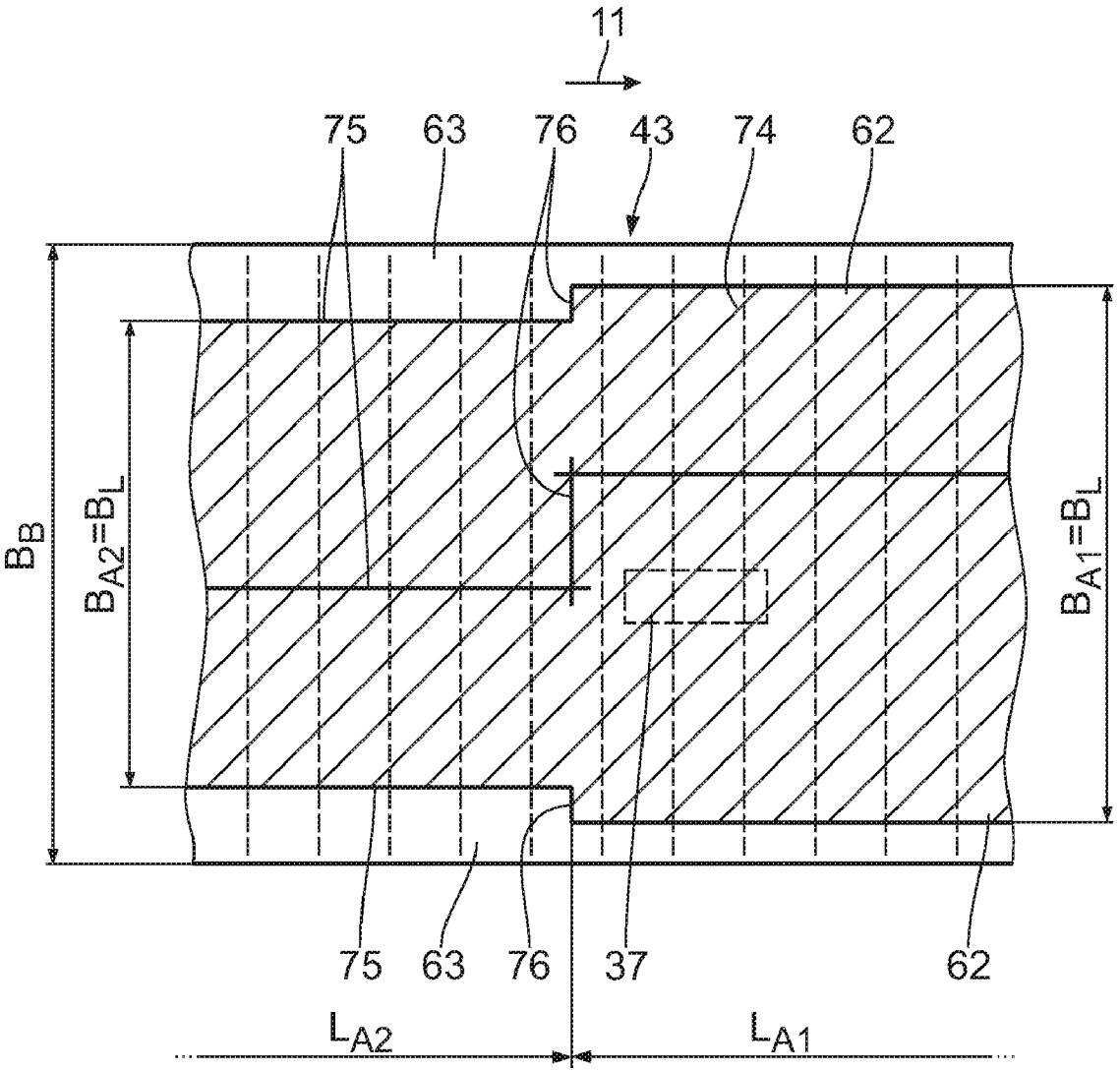
FIG. 7 shows a partial plan view of a web of corrugated cardboard.

The first splicing device 3 produces the endless first liner 7 which is supplied to the first production device 6. The second splicing device 4 produces the endless web of material 9 which is at first supplied to the marking device 36. The marking device 36 produces a marking 37 on the underside of the web of material 9. FIG. 7 shows a marking 37 which is for instance a color marking and was produced by means of a solid coloring agent such as chalk. During the marking process, the marking device 36 transmits a signal to the control device 73.

The marked web of material 9 is supplied to the grooving device 5, wherein the grooving device 5 produces the corrugated web 12 from the web of material 9. In the first production device 6, the corrugated web 12 is coated with glue 26 in a first application zone 74 and is bonded to the first liner 7 to form the single-face web of corrugated cardboard 2. The application zone 74 has a width which equals the application width $B_L$ of the first gluing device 18. The measuring device 17 continuously measures the rotational speed of the second grooving roller 16 and transmits the measured speed values to the control device 73.

For processing the first order $A_1$, the application widths $B_L$ of the gluing devices 18, 44 was adapted to the first order width $B_{A1}$. To this end, the control device 73 actuated the drives 30 in order to displace the glue dams 23 along the direction of displacement 27 until the application widths $B_L$ were equal to the first order width $B_{A1}$. Furthermore, the control device 73 actuated the longitudinal cutting device 55 until the tool distance $B_W$ of the outer cutting tools 61 was equal to the first order width $B_{A1}$ in order to remove the edge strips 63. The edge strips 63 are substantially not covered with glue 26 since the application widths $B_L$ of the gluing devices 18, 44 are equal to the first order width $B_{A1}$ which is smaller than the web width $B_B$, thus preventing an escape of glue 26 from the sides.

After application of the marking 37, the single-face web of corrugated cardboard 2 is supplied to the storage device 32 where it is temporarily stored in loops 35, thus forming a buffer. The single-face web of corrugated cardboard 2 is moved in the direction of conveyance 11 from the storage-device front end 33 to the storage-device rear end 34 where it is supplied to the detector device 38.

In the detector device 38, the applied marking 37 is detected by means of the optical detector 40, wherein an electric signal is transmitted to the control device 73 during the detection process. The time interval between the electric signals, which are generated when the marking 37 is applied and detected, enables the control device 73, together with the measured rotational speed of the second grooving roller 16, to determine the first partial web length $L_{11}$ of the web of corrugated cardboard 2 between the first production device 6 and the storage-device rear end 34. The described marking and detection process is repeated periodically, with the result that markings 37 are applied and detected continuously so that the determination of the first partial web length $L_{11}$ can be repeated in short time intervals. The current first partial web length $L_{11}$ is thus known at all times. Together with the constant, known second partial web length $L_{12}$, the control device 73 continuously determines the current first web length $L_1$ of the web of corrugated cardboard 2, 43 between the first production device 6 and the longitudinal cutting device 55. The constant, known second web length $L_2$ is stored in the control device 73.

After detection of the marking 37, the single-face web of corrugated cardboard 2 is supplied to the second production device 39. In the second production device 39, the corrugated web 12 of the single-face web of corrugated cardboard 2 is coated with glue 26 in a second application zone 74 which has a width that equals the application width $B_B$ of the second gluing device 44. By means of the pressing table 48 and the pressing belt 49, the single-face web of corrugated cardboard 2 covered with glue 26 is joined to the second liner 42 to form the double-face web of corrugated cardboard 43.

The double-face web of corrugated cardboard 43 is afterwards supplied to the longitudinal cutting and grooving device 55, 54 and to the cross-cutting device 64 by means of which longitudinal cuts 75 and crosscuts 76 connecting said longitudinal cuts 75 are produced. The outer longitudinal cuts 75 cut the edge strips 63 off the partial webs of corrugated cardboard 62. The cut-off edge strips 63 are discharged by means of the edge-strip discharge device 68 while the partial webs of corrugated cardboard 62 are, for further processing, guided across the diverter 69 in order to be distributed among two planes.

A format change is required for processing the second order $A_2$. Determined by means of a measuring device (not shown), the web speed of the web of corrugated cardboard 2, 43 downstream of the storage device 32 enables the control device 73 to continuously determine a first partial order length $L_{A11}$ which had already been processed in the longitudinal cutting device 55, and a second partial order length $L_{A12}$ which is still to be processed by means of the longitudinal cutting device 55. During a format change, the control device 73 initially actuates the first gluing device 18, wherein the glue dams 23 are displaced by means of the drives 30 along the direction of displacement 27 until the application width $B_L$ equals the second order width $B_{A2}$. The application width $B_L$ is changed in dependence on the first web length $L_1$ determined by means of the control device 73 at the very moment when the first web length $L_1$ is equal to the second partial order length $L_{A12}$ of the first order $A_1$ which is still to be processed. The corrugated web 12 is thus covered with glue 26 on the side facing the first liner 7 in an application zone 74 which has a width that is equal to the application width $B_L$, wherein the application width $B_L$ is smaller than the web width $B_B$.

After actuation of the first gluing device 18, the control device 73 subsequently actuates the second gluing device 44. The glue dams 23 of the second gluing device 44 are displaced along the direction of displacement 27 by means of the drives 30 such that the application width $B_L$ of the second gluing device 44 equals the second order width $B_{A2}$. The second gluing device 44 is actuated at the very moment when the second web length $L_2$, determined by means of the control device 73, equals the second partial order length $L_{A12}$ of the first order $A_1$ which is still to be processed. The corrugated web 12 is thus covered with glue 26 on the side facing the second liner 42 in an application zone 74 which has a width that equals the application width $B_L$ of the second gluing device 44. Although the application widths $B_L$ of the first and second gluing devices 18, 44 are changed successively, the application zones 74 on both sides of the web of corrugated cardboard 12 correspond to each other in terms of their respective positions since the application width $B_L$ of the gluing devices 18, 44 is changed in dependence on the web lengths $L_1$, $L_2$.

During the format change, the cutting tools 61 of the longitudinal cutting device 55 are displaced crosswise to the direction of conveyance 11 by means of the control device 73 after changing the application width $B_L$ of the second gluing device 44. The outer cutting tools 61 are displaced crosswise to the direction of conveyance 11 until the tool width $B_W$ thereof equals the order width $B_{A2}$ of the second order $A_2$. The outer cutting tools 61 are displaced at the very moment when the order $A_1$ has been completely processed by the longitudinal cutting device 55, in other words when the second partial order length $L_{A12}$ is equal to zero. The outer cutting tools 61 thus cut off the edge strips 63 to which substantially no glue is applied. Consequently, an escape of glue 26 from the edges is prevented even when processing the second order $A_2$.

Preventing the escape of glue 26 from the edges substantially avoids contamination of components of the corrugated cardboard machine 1, such as the grooving rollers 14, 16 or the heating plates of the pressing table 48, with the result that there are no downtimes of the corrugated cardboard machine 1 due to cleaning.

The process of determining the web lengths $L_1$, $L_2$ is also useful in terms for the synchronization of splices which are created during the production of the endless liners 7, 42. With respect to splice synchronization, reference shall be made to DE 10 2007 027 879.0.

The present invention is also applicable to webs of corrugated cardboard comprising more than three layers, for instance five layers. In this case, it is necessary to determine the web lengths of all webs of corrugated cardboard between the production devices and the longitudinal cutting device.

What is claimed is:

1. A corrugated cardboard machine for production of an endless web of corrugated cardboard, the corrugated cardboard machine comprising a. at least one production device (6, 39) for producing an endless web of corrugated cardboard (2, 43) from a corrugated web (12) and at least one liner (7, 24), wherein i. the at least one production device (6, 39) comprises at least one gluing device (18, 44) for applying glue to the corrugated web (12), and wherein ii. the at least one gluing device (18, 44) is designed such that an application width ($B_L$) is variable crosswise to a direction of conveyance (11), b. a longitudinal cutting device (55) disposed downstream of the at least one production device (6, 39) when seen in the direction of conveyance (11) for longitudinal cutting of the endless web of corrugated cardboard (43), and c. an electronic control device (73) which is designed such that i. at least one web length ($L_1$, $L_2$) of the web of corrugated cardboard (2, 43) between the at least one production device (6, 39) and the longitudinal cutting device (55) is detectable, and ii. the application width ($B_L$) is variable in dependence on the at least one web length ($L_1$, $L_2$).

2. A corrugated cardboard machine according to claim 1, wherein the longitudinal cutting device (55) comprises two cutting tools (61) which are displaceable crosswise to the direction of conveyance (11) for longitudinal cutting at the edges of the endless web of corrugated cardboard (43).

3. A corrugated cardboard machine according to claim 2, wherein the control device (73) is designed such that a tool distance ($B_W$) of the cutting tools (61) is adaptable to the application width ($B_L$).

4. A corrugated cardboard machine according to claim 1, wherein a first production device (6) is provided for producing a single-face web of corrugated cardboard (2).

5. A corrugated cardboard machine according to claim 4, wherein the control device (73) is designed such that a first web length ($L_1$) of the web of corrugated cardboard (2, 43) between the first production device (6) and the longitudinal cutting device (55) is detectable and the application width ($B_L$) of a first gluing device (18) is variable in dependence on the first web length ($L_1$).

6. A corrugated cardboard machine according to claim 4, wherein a storage device (32) for temporary storage of the single-face web of corrugated cardboard (2) is arranged between the first production device (6) and the longitudinal cutting device (55).

7. A corrugated cardboard machine according to claim 6, wherein a marking device (36) is provided upstream of the storage device (32) when seen in the direction of conveyance (11) for detecting the first web length ($L_1$) and a detector device (38) is provided downstream of the storage device (32) when seen in the direction of conveyance (11).

8. A corrugated cardboard machine according to claim 4, wherein a second production device (39) is provided downstream of the first production device (6) when seen in the direction of conveyance (11) for producing a double-face web of corrugated cardboard (43).

9. A corrugated cardboard machine according to claim 8, wherein the control device (73) is designed such that a second web length ($L_2$) of the web of corrugated cardboard (2, 43) between the second production device (39) and the longitudinal cutting device (55) is detectable and the application width ($B_L$) of a second gluing device (44) is variable in dependence on the second web length ($L_2$).

10. A method of producing an endless web of corrugated cardboard, the method comprising the following steps:

providing a corrugated web (12) and at least one liner (7, 42), applying glue to an application zone (74) of the corrugated web (12) by means of at least one production device (6, 39), wherein the application zone (74) has an application width ($B_L$) crosswise to a direction of conveyance (11), joining the corrugated web (12) coated with glue (26) to the at least one liner (7, 42) to form an endless web of corrugated cardboard (2, 43) by means of the at least one production device (6, 39), detecting at least one web length ($L_1$, $L_2$) of the web of corrugated cardboard (2, 43) between the at least one production device (6, 39) and a longitudinal cutting device (55), changing the application width ($B_L$) in dependence on the at least one detected web length ($L_1$, $L_2$), and longitudinal cutting of the web of corrugated cardboard (43) by means of the longitudinal cutting device (55).

* * * * *